US010231490B2

(12) United States Patent
Bisson et al.

(10) Patent No.: US 10,231,490 B2
(45) Date of Patent: Mar. 19, 2019

(54) BIB WITH MOVABLE TROUGH

(71) Applicant: M is for Monkey, LLC, Wilton, CT (US)

(72) Inventors: Dina Bisson, Wilton, CT (US); Serge Bisson, Wilton, CT (US)

(73) Assignee: M is for Monkey, Wilton, CT (US)

( * ) Notice: Subject to any disclaimer, the term of this patent is extended or adjusted under 35 U.S.C. 154(b) by 0 days.

(21) Appl. No.: 15/425,139

(22) Filed: Feb. 6, 2017

(65) Prior Publication Data

US 2018/0220715 A1 Aug. 9, 2018

(51) Int. Cl.
*A41B 13/10* (2006.01)

(52) U.S. Cl.
CPC ..... *A41B 13/103* (2013.01)

(58) Field of Classification Search
CPC ..... A41B 13/10; A41B 13/103; A41B 13/106
See application file for complete search history.

(56) References Cited

U.S. PATENT DOCUMENTS

| | | | | | |
|---|---|---|---|---|---|
| 677,010 | A * | 6/1901 | Ziller | | 2/49.2 |
| 4,649,572 | A | 3/1987 | Roessler | | |
| 4,924,527 | A * | 5/1990 | Hintermeyer | A41B 13/103 | 2/46 |
| 5,046,980 | A * | 9/1991 | Tai | A41B 13/10 | 2/49.4 |
| 5,107,545 | A | 4/1992 | Potter | | |
| 5,799,336 | A | 9/1998 | Cooper | | |
| 6,105,165 | A * | 8/2000 | Johnson | A41B 13/103 | 2/247 |
| 6,826,780 | B1 * | 12/2004 | Romesburg | A41B 13/103 | 2/48 |
| 2011/0016598 | A1 | 1/2011 | Fletcher | | |
| 2011/0067161 | A1 | 3/2011 | Perazzo | | |
| 2013/0291276 | A1 | 11/2013 | Monahon | | |
| 2014/0250557 | A1 | 9/2014 | Amrikhas | | |
| 2015/0272229 | A1 * | 10/2015 | Lu | A41B 13/103 | 2/49.2 |
| 2017/0303602 | A1 * | 10/2017 | Petersen | A41B 13/103 | |

FOREIGN PATENT DOCUMENTS

| | | | | |
|---|---|---|---|---|
| GB | 2450106 A | * 12/2008 | | A41B 13/103 |
| WO | WO 2008/113016 A1 | 9/2008 | | |

OTHER PUBLICATIONS

Product Literature for OXO International, Ltd, "Tot Roll Up Bib" located at http://www.oxo.com/products/baby-toddler/feeding/oxo-tot-up-bob#apple-green.
Product Literature for Mayborn USA Inc. "Tommee Tippee" located at https://www.tommeetippee.us/product/easi-roll-bib.
PCT International Search Report and Written Opinion for PCT/US2018/15303 dated Mar. 11, 2018.

* cited by examiner

*Primary Examiner* — Tejash Patel
(74) *Attorney, Agent, or Firm* — McCarter & English, LLP

(57) ABSTRACT

Bib designs are provided that generally include a bib body and a trough mounted with respect to the bib body. The trough may be detachably mounted with respect to the bib body. The trough advantageously moves between an open/expanded state and a close/collapsed state. The bib body may cooperate with a detachable burp cloth. The bib body and the trough may be provided or appear with various shapes and features to mimic the faces/upper torsos of animals, people, cartoon characters, clowns, comic book characters and the like.

19 Claims, 3 Drawing Sheets

1 PROTOTYPE 1 - CLOSED

2 PROTOTYPE 1 - OPEN

V1 VERT. SECTION - CLOSED

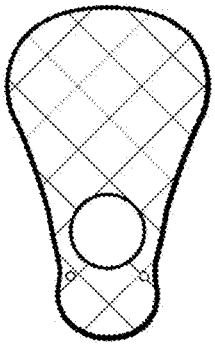
Fig. 6
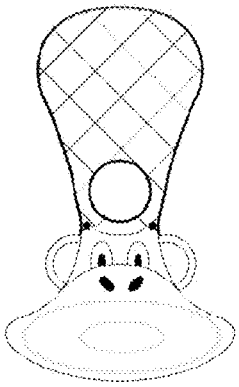
Fig. 7
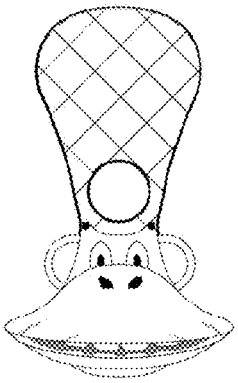
Fig. 8
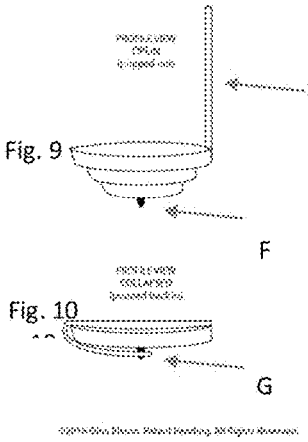
Fig. 9
Fig. 10
Fig. 11
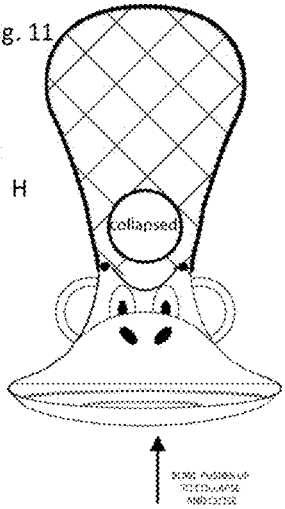
Fig. 12
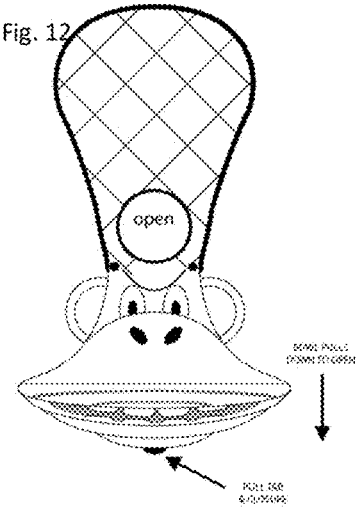

BIB WITH MOVABLE TROUGH

BACKGROUND

1. Technical Field

The present disclosure relates to bib designs and associated methods for use in feeding infants/toddlers and, more particularly, to bib designs/methods that advantageously capture/collect food pieces, crumbs and the like at or adjacent the base of the bib.

2. Background Art

A variety of bibs have been used over the years in an attempt to protect the infant or toddler from soiling his/her clothing during the feeding process. Bibs may be fabricated from cloth materials with the intent that they be laundered after one or more uses, e.g., when they become sufficiently soiled that reuse prior to cleaning is undesirable. Other bibs have been fabricated, in whole or in part, from plastic materials. Thus, for example, the protective face of the bib may be fabricated from a plastic material, such that a "wipe-down" is generally sufficient to remove food debris and prepare the bib for reuse.

One bib product is commercially available from OXO International, Ltd. as the "Tot Roll Up Bib". The noted OXO product features a silicone pocket at the base of a fabric bib that is designed to catch stray pieces of food that miss the baby's mouth. The OXO bib's fabric may be rolled up and stored in the silicone pocket between uses.

A similar product is commercially available from Mayborn USA Inc. under the tradename "Tommee Tippee". The Mayborn product includes a crumb catcher that is designed to collect crumbs and mess, rolls up, is made from soft and light material, wipes clean and includes dimpled reverse that helps prevent irritation on delicate skin.

Despite efforts to date, a need remains for improved bib products that more effectively meet the needs encountered in feeding infants and toddlers. These and other needs are satisfied by the bib products described herein.

SUMMARY

The present disclosure provides advantageous bib designs. The disclosed bib designs generally include a bib body and a trough that is mounted with respect to the bib body. The trough may be detachably mounted with respect to the bib body. The trough advantageously moves between an open/expanded state and a close/collapsed state. The bib body may cooperate with a detachable burp cloth. The bib body and the trough may be provided or appear with various shapes and features to mimic the faces/upper torsos of animals, people, cartoon characters, clowns, comic book characters and the like.

Additional features, functions and benefits of the disclosed bib designs will be apparent from the detailed description which follows, particularly when read in conjunction with the accompanying figures.

BRIEF DESCRIPTION OF THE DRAWINGS

To assist those of skill in the art, reference is made to the accompanying figures, wherein:

FIG. 6 is a front perspective view of an exemplary burp cloth that includes, inter alia, a mechanism for attaching the burp cloth to a bib according to the present disclosure;

FIG. 7 is a front perspective view of a burp cloth/bib combination according to the present disclosure, with the trough in the collapsed/closed state or position;

FIG. 8 is a front perspective view of the burp cloth/bib combination of FIG. 7, with the trough in the expanded/open state or position;

FIG. 9 is a vertical profile view of an alternative bib/trough in an expanded/open state or position, according to the present disclosure;

FIG. 10 is a vertical profile view of the bib/trough of FIG. 9 in a collapsed/closed state or position, according to the present disclosure;

FIG. 11 is a front perspective view of a further exemplary burp cloth/bib combination according to the present disclosure, with the trough in a collapsed/closed state or position;

FIG. 12 is a front perspective view of the burp cloth/bib combination of FIG. 11, with the trough in an expanded/open state or position;

DESCRIPTION OF EXEMPLARY EMBODIMENTS

Features, benefits and advantages of embodiments of the present invention will be apparent from the following detailed description, wherein exemplary bibs according to the present disclosure are described with reference to the accompanying figures. Although the present invention is described with reference to exemplary implementations, it is to be understood that the present disclosure is not limited by or to the disclosed embodiments, but is susceptible to various modifications, refinements and/or enhancements without departing from the spirit or scope of the present disclosure.

Before describing exemplary embodiments of the present disclosure, it is noted that materials for use in fabricating the disclosed bib products generally include food-grade, natural and synthetic polymers and various types of fabrics comprising natural and synthetic fibers. Alternative materials and combinations of materials may be employed, as will be apparent from persons skilled in the art, provided the selected material(s) are properly employed in a food-related environment and provide the requisite structural and functional attributes as described herein below.

Figure 1:
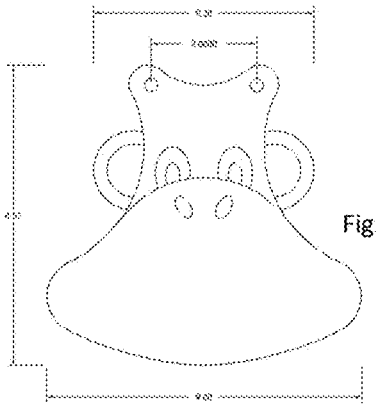
FIG. 1 is a front perspective view of a first exemplary bib in the "closed" or collapsed position according to the present disclosure.

With reference to the accompanying figures, FIG. 1 is a front perspective view of an exemplary embodiment of the disclosed bib of the present disclosure in the "closed" state. More particularly, the disclosed bib includes a trough that is positioned at a lower portion of the bib and that is designed to move between a first position, i.e., an expanded/open position, and a second position, i.e., a collapsed/closed position. As schematically depicted in FIG. 1, the bib is shown with the body of the bib supporting a trough at a lower end/extremity thereof, the trough being in a collapsed or closed state. Two holes (designated by reference "A" in FIG. 2) are formed on either side of the bib body at a top end/extremity. The holes may be used to releasably fasten the bib with respect to a secondary bib component, bib cloth, and or burp cloth.

Figure 2:
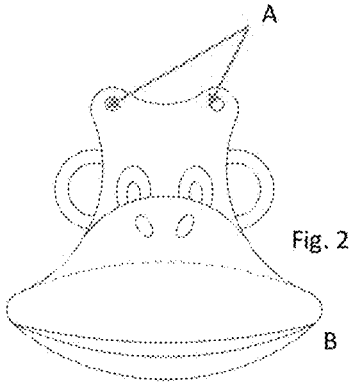
FIG. 2 is a front perspective view of the first exemplary bib of FIG. 1 in the "open" or expanded position according to the present disclosure.

FIG. 2 is a front perspective view of the bib embodiment of FIG. 1 in the "open" state (designated by reference "B"), wherein the trough is flexed or extended away from the bib body so as to define a cavity that is configured and dimensioned to catch food and liquid when in the expanded/open state. The exemplary design of FIGS. 1 and 2 provide a peek-a-boo effect to reveal an animal character and/or mouth of the animal when the trough is in the expanded/open state. The character and/or mouth is hidden from view when the trough is collapsed and in the closed state, i.e., as shown in FIG. 1.

Figure 3:
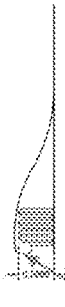
FIG. 3 is a vertical profile view of the first exemplary bib of FIGS. 1 and 2, in the closed state (as shown in FIG. 1), according to the present disclosure.

FIG. 3 is a vertical profile view of the exemplary bib of the present disclosure in the "closed" state (i.e., as shown in FIG. 1). The profile/side view of FIG. 3 demonstrates how the bib generally appears when it is collapsed, with margin for potential deviation in compactness due to material wear and fatigue over time. A button, snap, magnet, Velcro, fabric or polymer fastener (designated by "C") is generally provided to detachably secure the trough area to the bib body to ensure proper closure. In some embodiments, a closure mechanism may be omitted from the bib or may be implemented differently from any of the examples shown or described herein, provided the overall design of the bib/trough is effective to move between an open and a closed state, and maintain such respective positions unless/until it is desired to reposition the trough.

Figure 4:
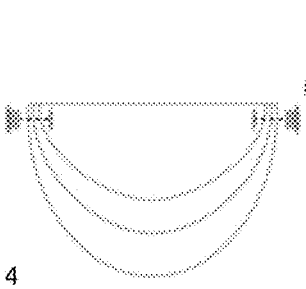
FIG. 4 is a top planar view of a trough according to an exemplary embodiment of the disclosed bib.

FIG. 4 is a top planar view of an exemplary bib trough according to the present disclosure. The exemplary trough shown in FIG. 4 includes a hinge mechanism D that permits the trough to move with respect to the bib body. The arcuate lines shown in FIG. 4 reflect ribs that are defined and/or embedded relative to the trough to facilitate movement thereof. The hinge mechanism D facilitates a swiveling or rotational effect of the trough to expand and collapse the trough. Thus, the axis of travel of the trough when moving between the expanded/open position and the collapsed/closed position is substantially arcuate. The hinge mechanism D generally includes a pair of hinge elements that are positioned on opposite sides of the trough. The hinge elements are shown in a "phantom" detached position for illustration purposes. Each hinge element defines an axle- or rod-like extension that passes through a channel or aperture formed in the trough. The hinge elements may be constructed of silicone or plastic polymer materials, and function to generate a frictional force relative to the trough so as to maintain the trough in an expanded (or partially expanded) or collapsed position unless and until repositioned by the user (or otherwise subjected to a force that overcomes the noted frictional forces).

Figure 5:
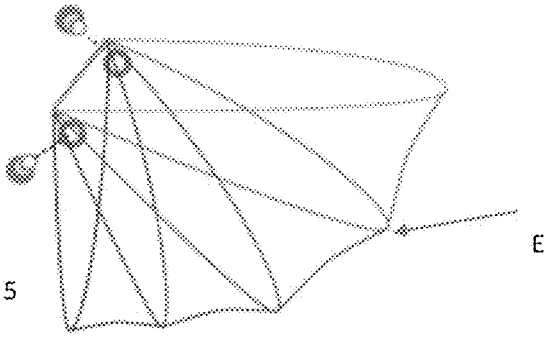
FIG. 5 is an isometric view of the exemplary trough of FIG. 4.

FIG. 5 is an isometric view of the exemplary trough of FIG. 4 shown in the expanded state (with the hinge elements in a "phantom" detached position for illustration purposes). The perspective view of FIG. 5 illustrates the inner-workings and design of an exemplary expandable/collapsible trough of the present disclosure that includes a plurality or wire-like rib structures E to maintain the shape integrity of the trough while in the expanded and collapsed states. The disclosed wire-like rib structures E may be fabricated, in whole or in part, from a material selected from aluminum wire, metal wire, thin plastic or polymer tubes. The wire-like rib structures E may be embedded in the trough, passed through channels defined in the trough and/or mounted with respect to the trough (e.g., using an adhesive, sonic welding or the like). The individual wire-like rib structures E are generally of different lengths so as to accommodate expansion/collapse as shown in FIG. 5. In addition, the wire-like rib structures E are generally spaced so that, when expanded, trough material is suspended between adjacent rib-like structures E. The longest rib-like structure E generally defines the upper edge/rim of the trough and, in exemplary embodiments, is substantially horizontal when in the expanded position, i.e., when positioned substantially perpendicular to the bib body as shown in FIG. 5.

FIG. 6 is a front perspective view of an exemplary burp cloth according to the present disclosure. The burp cloth of FIG. 6 includes a plurality of (two) buttons or snaps that serve as a way to connect the disclosed burp cloth to an exemplary bib according to the present disclosure. Thus, the burp cloth may extend from the bib and define a neck opening for positioning relative to the neck of a toddler/infant. The burp cloth may be fabricated of conventional materials and is generally machine washable, as is known in the art.

FIG. 7 is a front perspective view of an embodiment of a bib/burp cloth combination according to the present disclosure, wherein the burp cloth is assembled/detachably connected to a bib according to the present disclosure. In FIG. 7, the bib is shown with the trough in the collapsed state/position, as described above.

FIG. 8 is a front perspective view of the bib/burp cloth combination of FIG. 7 with the trough in the expanded/open state or position.

FIG. 9 is a vertical profile view of an alternative bib/trough embodiment in the "open" or expanded state according to the present disclosure. In the exemplary embodiment of FIG. 9, the schematic illustration demonstrates how the exemplary bib generally appears when it is expanded, with margin for potential deviation in compactness due to material wear and fatigue over time. The trough is defined by a plurality of nested cylindrical regions that have varying circumferences, whereby in a closed/collapsed state, the nested regions are substantially aligned in a planar orientation (see FIG. 10), but in an open/expanded state, the trough defines an increased volume of staggered (or stepped) cylindrical regions (see FIG. 9). In an exemplary embodiment, a pull tab F extends downwardly from the center-most cylindrical region of the trough and permits a user to easily extend the trough downwardly, thereby increasing the internal volume defined thereby. The pull tab F may be made from a polymer or silicone material and functions as mechanism for the user to pull and pop open the trough. The bib body H generally extends in a substantially perpendicular orientation (i.e., at a 90 degree angle) relative to the trough and sits against the child's body in use.

FIG. 10 is a vertical profile view of the bib embodiment of FIG. 9 with the trough in the "closed" or collapsed state, demonstrating how the bib may appear when it is collapsed, with margin for potential deviation in compactness due to material choice, wear and fatigue over time. Of note, the pull tab F may also act as or cooperate with a closure mechanism when the trough/bowl of the bib is closed/collapsed for storage, as illustrated by strap G. Thus, strap G cooperates with tab F to detachably maintain the trough in the closed/collapsed state. Thus, a button, snap, magnet, Velcro, fabric or polymer fastener may be implemented to secure the trough area to the bib body to ensure proper closure. In some embodiments, a closure may be positioned differently on the bib for optimal compactness.

FIG. 11 is a front perspective view of a further exemplary embodiment of a burp cloth/bib combination according to the present disclosure in an assembled configuration with the bib connected to the burp cloth, and with the trough in a collapsed/closed state.

FIG. 12 is a front perspective view of the burp cloth/bib embodiment of FIG. 11 with the bib assembled with the burp cloth, and with the trough being in an expanded or open state. Of note, the trough moves between the collapsed/closed state and the expanded/open state by pull a tab that extends downwardly from the center of the trough so as to increase the volume of the trough by extending downwardly a previously-nested bowl-like region of the trough. The bowl may be pushed upward into a nested configuration (see FIG. 11) to assume a collapsed/closed state.

Figure 13:
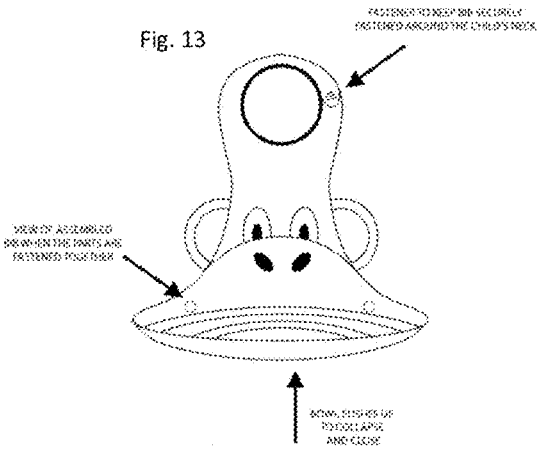
FIG. 13 is a front perspective view of a further exemplary bib/trough embodiment according to the present disclosure, with the trough connected to the bib body and in a collapsed/closed state.
Figure 14:
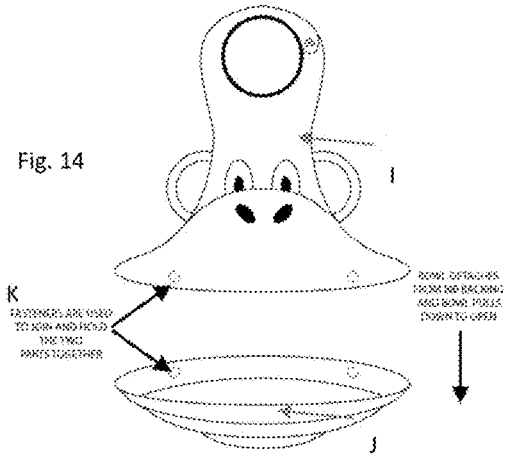
FIG. 14 is a front perspective view of the bib/trough embodiment of FIG. 13, with the trough in a detached and expanded/open state.

FIG. 13 is a front perspective view of a further embodiment of the present disclosure, wherein the trough is detachably mounted with respect to the bib body. Thus, a plurality of attachment structures, e.g., buttons, fasteners or the like, allow the trough to be mounted with respect to the bib body. In FIG. 13, the trough is mounted to the bib body, whereas in FIG. 14, the trough is separated from the bib body. Whether assembled or disassembled, the trough in the exemplary embodiment shown in FIGS. 13 and 14 is defined by an expandable bowl structure that may be nested (as shown in FIG. 13) and thereby collapsed/closed, or unnested (as shown in FIG. 14) and thereby expanded/open.

As noted above, FIG. 14 is a front perspective view of the bib embodiment of FIG. 13 which illustrates the bib backing I detached from the trough/bowl J (with the trough being in the expanded/open state). In this exemplary, embodiment, the trough/bowl may be used independent of the bib body as a collapsible bowl. Of note, fasteners K function to hold the two parts together in a detachable manner, and take various forms, i.e., various types of fasteners materials. In addition, the detachable functionality associated with the disclosed trough makes it possible to interchange troughs with bib bodies as and when desired.

Figure 15:
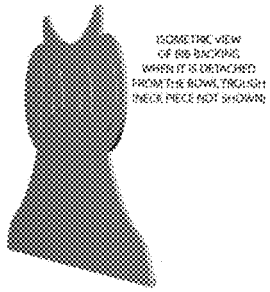
FIG. 15 is an isometric view of a bib backing according to a further exemplary embodiment of the present disclosure.

FIG. 15 is an isometric view of a bib body/bib backing detached from a bowl/trough according to a further exemplary embodiment of the present disclosure.

Figure 16:
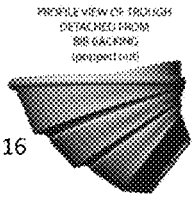
FIG. 16 is a profile view of a trough in an expanded/open state detached from a bib body according to the present disclosure.

FIG. 16 is a profile view of an embodiment of a bib trough detached from a bib body in an expanded/open state. Of note, fasteners for use in detachably securing the bib trough shown in FIG. 16 with the bib body/bib backing shown in FIG. 15 include various types of fastener designs and materials. The exemplary bib trough of FIG. 16 moves between an expanded and a collapsed state through an angular nesting process. Thus, when expanded, the front region (i.e., furthest from the bib body/bib backing when assembled) curves inwardly toward the bib body. When nested in a collapsed configuration, the bib trough has an angular travel path to assume a closed/nested configuration. Thus, as provided in the various embodiments disclosed herein, the axis of travel of the trough when moving between the expanded/open position and the collapsed/closed position may be substantially linear or substantially arcuate.

Figure 17:
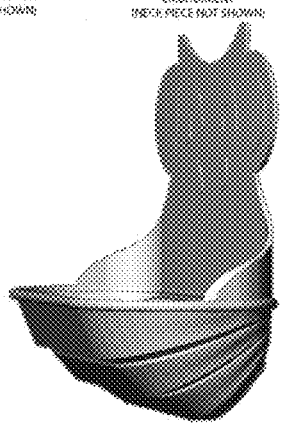
FIG. 17 is an isometric view of the bib body and bib trough of FIGS. 15 and 16 in an assembled configuration and with the trough in an expanded/open state.

FIG. 17 is an isometric view of the assembled bib embodiment. The portion of the bib body that defines a neck opening is not depicted in FIG. 17 (or FIG. 15). When assembled, the bib backing may advantageously curve in a forward direction in the region that interfaces with the upper rim of the bib trough, thereby providing a greater area of interface/connection between the bib body and the trough. The fastening mechanism between the bib body and the trough may take various forms in the region of interface, e.g., clasps, buttons, snap fit connectors and the like.

Figure 18:
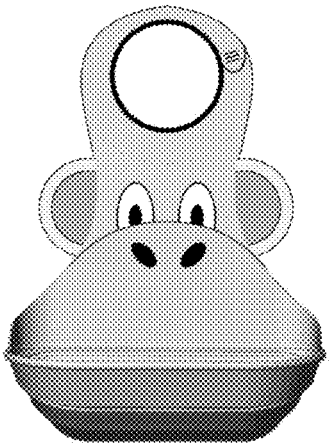
FIG. 18 is a front perspective view of a further exemplary embodiment of a bib/trough combination according to the present disclosure, with the trough in an expanded/open configuration.

FIG. 18 is a front perspective view of a further exemplary bib/trough embodiment according to the present disclosure. In the exemplary embodiment of FIG. 18, it is noted that the trough defines a substantially oval geometry with similar nesting functionality as described above, thereby permitting movement between an expanded/open state and a collapsed/closed state. The bib body curves outward relative to the plane of the bib body so as to provide a greater region of interface with the upper rim of the trough. Various fastening mechanisms may be employed between the bib body and the trough in the region of interface, e.g., clasps, buttons, snap fit connectors and the like.

Throughout the various embodiments described and depicted herein, the bib body and the trough may be provided or appear with various shapes and features to mimic the faces/upper torsos of animals, people, cartoon characters, clowns, comic book characters and the like. Thus, for example, the bib body may include features that resemble eyes and ears (see, e.g., FIGS. 1, 2, 7, 8, 11-15 and 17-18). The bib body and/or the trough may include feature(s) that resemble a nose (see same figures). The trough may take the form of a mouth (see FIGS. 1, 2, 7, 8, 11-14) or a lap/basket (see FIGS. 17-18). Movement of the trough between the open/expanded and the closed/collapsed position may resemble/mimic the opening and closing of a mouth. In addition, since the trough is designed to catch food that does not reach its intended destination, the infant/toddler may be entertained to think that this crumbs and other food portions are being "eaten" by the character represented on his/her bib/trough combination. Thus, in addition to the advantageous functionalities associated with the disclosed bib/trough combinations, the aesthetic and design aspects of the disclosed bib/trough combinations provide further benefits, as will be readily apparent to those accustomed to interacting with infants/toddlers.

Although the present disclosure has been described with reference to exemplary embodiments and implementations, it is to be understood that the present disclosure is not limited by or to such exemplary embodiments/implementations. Rather, the disclosed bib devices and systems are susceptible to many variations, modifications, enhancements and/or refinements without departing from the spirit or scope of the present disclosure.

The invention claimed is:

1. A bib, comprising:

a. a bib body, and b. a trough detachably mounted with respect to the bib body, wherein the trough is movable relative to the bib body between (i) an expanded configuration wherein the trough defines an expanded volume, and (ii) a collapsed configuration wherein the trough defines a reduced volume as compared to the expanded volume, and wherein movement of the trough between the expanded configuration and the collapsed configuration is along a substantially arcuate path.

2. The bib of claim 1, wherein the bib body and the trough define shapes and features that mimic at least one of a face or upper torso of an animal, a person, a cartoon character, a clown, or a comic book character.

3. The bib of claim 1, further comprising a hinge mechanism that cooperates with the trough to facilitate movement thereof.

4. The bib of claim 1, wherein the trough defines a circular or oval geometry.

5. The bib of claim 1, wherein the trough defines a bowl geometry.

6. The bib of claim 1, further comprising a burp cloth detachably mounted with respect to the bib body.

7. The bib of claim 1, wherein the bib body defines a neck portion adapted to receive the neck of a user.

8. The bib of claim 1, further comprising a strap for securing the trough in the collapsed/closed position.

9. The bib of claim 1, wherein the bib body defines a lower region that curves so as to establish a greater interface region with the trough.

10. The bib of claim 1, further comprising a securing mechanism for detachably securing the trough relative to the bib body.

11. The bib of claim 10, wherein the securing mechanism is selected from the group consisting of a button, snap, magnet, hook-and-loop fastener, fabric or polymer fastener.

12. The bib of claim 1, further comprising a closure mechanism for detachably maintaining the trough in the collapsed configuration.

13. The bib of claim 12, wherein the closure mechanism is selected from the group consisting of a button, snap, magnet, hook-and-loop fastener, fabric or polymer fastener.

14. The bib of claim 12, wherein the closure mechanism is a magnetic mechanism.

15. A bib, comprising:

a. a bib body, and b. an expandable and collapsible trough detachably mounted with respect to the bib body, wherein the expandable and collapsible trough includes a plurality of nested regions that define varying circumferences and distinct bases, and wherein the plurality of nested regions are axially movable relative to each other between (i) an expanded or open position in which the distinct bases of the plurality of nested regions are staggered or stepped, and (ii) a collapsed or closed position in which the distinct bases of the plurality of nested regions are substantially aligned in a planar orientation.

16. The bib of claim 15, wherein the plurality of nested regions are cylindrical.

17. The bib of claim 15, wherein the plurality of nested regions defines a center-most region, and further comprising a pull tab that extends downwardly from the center-most region.

18. The bib of claim 17, further comprising a strap that cooperates with the pull tab to detachably maintain the plurality of nested regions in the collapsed or closed position.

19. The bib of claim 1, wherein the trough includes at least (i) a first arcuate rib, and (ii) a second arcuate rib that is shorter in length than the first arcuate rib, and wherein in the expanded configuration, the first arcuate rib defines an upper rim of the trough.

* * * * *